United States Patent [19]

Dohler et al.

[11] Patent Number: 4,810,365

[45] Date of Patent: Mar. 7, 1989

[54] HYDROGENATION OF MINERAL OILS CONTAMINATED WITH CHLORINATED HYDROCARBONS

[75] Inventors: Werner Dohler, Marl-Polsum; Rolf Holighaus, Haltern; Klaus Niemann, Oberhausen, all of Fed. Rep. of Germany

[73] Assignee: Veba Oel Aktiengesellschaft, Gelsenkirchen, Fed. Rep. of Germany

[21] Appl. No.: 71,639

[22] Filed: Jul. 9, 1987

[30] Foreign Application Priority Data

Jul. 11, 1986 [DE] Fed. Rep. of Germany ..... 3623430

[51] Int. Cl.[4] ..... C10G 45/04

[52] U.S. Cl. ..... 208/262.1; 208/262.5; 210/909

[58] Field of Search ..... 208/262; 210/909

[56] References Cited

U.S. PATENT DOCUMENTS

| | | | |
|---|---|---|---|
| 2,375,460 | 5/1945 | Barbre | 208/262 |
| 2,377,546 | 6/1945 | Frey | 208/262 |
| 2,409,372 | 10/1946 | Matsuzak | 208/262 |
| 2,412,220 | 12/1946 | Ibach et al. | 208/262 |
| 2,413,871 | 1/1947 | Hepp | 208/262 |
| 2,535,735 | 12/1950 | Groebe et al. | 208/262 |
| 2,917,456 | 12/1959 | Ashley | 208/213 |
| 3,284,344 | 11/1966 | Demeester et al. | 208/262 |
| 3,355,376 | 11/1967 | Gorin et al. | 208/262 |
| 3,595,931 | 7/1971 | Hay et al. | 208/262 |
| 3,855,347 | 12/1974 | Oricchio | 208/262 |
| 3,925,193 | 12/1975 | Conslantikes et al. | 208/262 |
| 3,935,295 | 1/1976 | La Hue et al. | 208/262 |
| 4,351,978 | 9/1982 | Hatano et al. | 585/469 |
| 4,599,472 | 7/1986 | Cobb | 208/262 |
| 4,601,817 | 7/1986 | Globus | 208/262 |
| 4,623,448 | 11/1986 | O'Connell et al. | 208/262 |
| 4,719,007 | 1/1988 | Johnson et al. | 208/262 |

FOREIGN PATENT DOCUMENTS

| | | | |
|---|---|---|---|
| 0178001 | 4/1986 | European Pat. Off. . | |
| 0101847 | 9/1978 | Japan | 208/262.5 |
| 2063908 | 6/1981 | United Kingdom | 208/262.5 |

OTHER PUBLICATIONS

Chemical Abstracts, vol. 81, No. 3, Jul. 22, 1974, p. 314.
Chemical Abstracts, vol. 89, No. 13, Sep. 25, 1978, p. 257.

*Primary Examiner*—H. M. S. Sneed
*Assistant Examiner*—Helane Myers
*Attorney, Agent, or Firm*—Oblon, Fisher, Spivak, McClelland & Maier

[57] ABSTRACT

Halogen-containing oils and hydrocarbons are treated on an industrial scale whereby the mineral base oils comprising the main component of the oils hydrocarbons can be reused. The oils are subjected to a high pressure hydrogenation under typical conditions of liquid phase hydrogenation or of combined liquid-phase and gas-phase hydrogenation, at hydrogen pressures of 20–325 bar, temperatures of 250°–500° C., and gas/oil ratios of 100–300 $m^3$ per metric ton at STP.

20 Claims, No Drawings

HYDROGENATION OF MINERAL OILS CONTAMINATED WITH CHLORINATED HYDROCARBONS

BACKGROUND OF THE INVENTION

1. Field of the Invention

The invention relates to a method of treatment of mineral oils or their distillation residues by hydrogenation, particularly so-called waste oils contaminated with halogenated hydrocarbons such as chlorinated biphenyls, brominated biphenyls, chlorinated naphthalenes, chlorinated terphenyls, other chlorinated aromatics, chlorinated paraffins, and/or chlorinated napthenes (chlorinated cycloparaffins).

2. Discussion of the Background

Among the chlorinated hydrocarbons, an urgent need exists for a safe method of disposing of the polychlorinated biphenyls (PCB's). These compounds have been made subject to maximum allowable concentration standards in the workplace, for example, of 0.5–1.0 mg/m$^3$ (depending on chlorine content which concentrations have been quoted as maximum limits in the F.R. of Germany), as well as stringent government regulations relating to their manufacture and use. Because of their thermal and chemical stability and their dielectric properties, they have been employed as insulating and cooling fluids in high-current capacitors, transformers, and rectifiers; as plasticizers for paints, varnishes, and plastics; as impregnating fluids in packings and seal liquids in liquid seals; as hydraulic oils; and as heat transfer media (see "Roempps Chemielexikon", 8th Ed. p. 715).

Due to the low environmental degradability of chlorinated biphenyls and other related chlorinated hydrocarbons, there is a need for safe means of disposing of them on an industrial scale.

In particular, PCB-containing liquids and used PCB-containing liquids mixed into oil residues must be regarded as hazardous waste, which must be identified, specially treated, and safely stored and/or disposed of.

A number of methods of treating chlorinated biphenyls for disposal purposes have been developed. These include methods of thermal incineration, adsorption, solvent extraction, catalytic treatment with hydrogen in the presence of organic solvents, chlorolysis treatment with chlorine in the vapor phase, dehalogenation by sodium or organosodium compounds, microwave plasma treatment, ozonation, reaction in the presence of oxygen with a reagent prepared from sodium metal and polyethylene glycols, cleavage of the PCB molecule into biphenyl and chlorine, and direct oxidation of chlorinated biphenyls by air or oxygen in an aqueous phase in the presence of acids at high temperatures (see Ackerman, D. G., et al., 1983, "Destruction and disposal of PCBs by thermal and nonthermal methods", Noyes Data Corp., Park Ridge, N.J.).

None of the above-mentioned methods can be considered as suitable and unconditionally applicable for all application situations. Thus, the thermal incineration methods require extensive precautionary means for monitoring and possible post-treating of the flue gases generated, as well as treatment and disposition of solid residues which may be produced. Nonetheless, these methods are the most highly developed and most widely used. Some of the other methods are only at the bench or pilot stage of development.

As an example, see the research report of Kranich, W. L., et al., 1977, "Process for hydrodechlorination of polychlorinated hydrocarbons", Am. Chem. Soc. (Div. Pesticide Chem.), 194th Ann. Mtg., Chicago, Ill. The parameters mentioned for this process are a hydrogen pressure of 30–50 bar, Ni/kieselgur or Pd/carbon catalyst, and temperatures about 100°–120° C. The solvent used is NaOH in ethanol. Such a process requires extensive solvent processing and recycling. Accordingly, no industrial implementation of such a process is known.

SUMMARY OF THE INVENTION

Accordingly, one object of the present invention is to provide a method of processing halogen-containing waste oils which allows the mineral base-oils present as the main component to be reused.

Another object of the invention is to provide a method of processing halogen-containing waste oils in which the waste oils are not consumed by combustion or other decomposition processes.

Another object of the invention is to provide a method which can be used on an industrial scale and which results in the decomposition of PCB's to $\leqq 1$ ppm residual concentration.

These and other objects of the present invention which will become apparent from the following specification have been achieved by the present method of treating a halogen-containing oil or hydrocarbon which comprises hydrogenating the halogen-containing oil or hydrocarbon at a hydrogen pressure between about 20–325 bar, a temperature between about 250°–500° C. and a gas/oil ratio of 100–300 m$^3$ per metric ton at S.T.P. (Standard Temperature and Pressure), wherein the hydrogenation occurs in a slurry type bubble column reactor or in a combination of such a reactor with a fixed catalyst bed reactor.

DETAILED DESCRIPTION OF THE PREFERRED EMBODIMENTS

In the process of the present invention, halogen-containing feed materials are subjected to high pressure hydrogenation under the typical conditions of a liquid phase hydrogenation in a slurry type bubble column reactor or in a combination of such a reactor with a fixed catalyst bed reactor, with hydrogen pressures of 20–325 bar, temperatures of 250°–500° C., and gas/oil ratios of 100–3000 m$^3$/metric ton (at S.T.P.).

This method is particularly suitable for treating PCB-containing waste oils or waste oils mixed with metal drilling oils, cutting oils, transformer oils, hydraulic oils, or the like, in a liquid phase hydrogenation in a slurry type bubble column reactor or in the combination of hydrogenation in the aforesaid reactor with further hydrogenation in a fixed catalyst bed reactor. The oils to be treated are preferably fed directly to the slurry phase reactor, or in mixtures with residual oils, heavy oils, or even finely ground coal. In the case of coal addition, an additional stage of preparation of the coal-/oil mixture is provided.

Depending on the desired degree of conversion and the tendency of the oil fed to form coke, in preparing the mixture it may be advantageous to add a high-surface, finely-divided suspended material ("additive"), which optionally may be impregnated with heavy metal salts, particularly iron (II) sulfate. This additive may be consumed in the process. After addition of said additive, the feed mixture is passed through a compression stage, and hydrogen-containing recycle gas and fresh hydrogen are added to it. After passing through heat exchangers where heat exchange with product streams takes place to heat the feed mixture, the mixture then passes through a so-called preheater, from where it is fed to the bottom of a liquid phase reactor. Alternatively, it is possible to add the fresh and/or recycle hydrogen after the feed mixture has passed heat exchangers or the pre-heater oven. The reactor itself is generally a vertical column reactor without internal mounted structures such as baffles, plates and the like. The hydrogenation is carried out at high pressure, preferably at hydrogen pressures of 20–325 bar, and elevated temperature, preferably between 250° and 500° C. Most preferred hydrogen pressures are from 100–250 bar, and most preferred temperatures are in the range of 350°–450° C. The gas-/oil ratios used are preferably 100–3000 $m^3$ (at S.T.P.) per metric ton, with the gas being a hydrogen-containing hydrogenation gas. The desired degree of conversion and the required degree of removal of, e.g., chlorinated biphenyls, determine the flow rate of the feed product. Typical throughputs are 0.4–1.0 metric ton/$m^3$/hr. Where oil components and coal are fed together, or in the presence of an "additive" or other residual materials, e.g. drill turnings, the reaction products are advantageously sent to a hot separator unit operated at the reaction pressure and at a temperature preferably 20°–50° C. below the reaction temperature. Here the uncondensed hydrocarbons are drawn off at the top and the residue-containing bottoms are drawn off at the bottom. Distillable heavy oil components can be separated out from the bottoms downstream, in a stripper unit, and can be combined with the top product of the hot separator and sent to further processing. The stripper residue containing carbon and hydrocarbon can be used to generate hydrogen by a gasification reaction or for energy production.

A catalytic phase hydrogenation may be carried out downstream of the above-described liquid phase hydrogenation, for further processing of the uncondensed reaction products which were drawn off from the top of the hot separator. No reheating is required. This catalytic operation involves further hydrogenation, stabilization, and removal of, e.g., heteroatoms such as sulfur or nitrogen. The object is a naphtha quality which meets reformer feed specifications, and a directly saleable middle distillate. The gas phase hydrogenation is carried out on fixed bed catalysts, using conventional catalysts. After passing through the gas phase hydrogenation, the product streams are condensed and cooled by intensive heat exchange, and are separated into a liquid phase and a gas phase, in a high pressure cold separator. After the liquid phase is de-pressurized, it is generally passed through a stabilizer column, to remove the $C_4$ products and to produce a stabilized syncrude. The gaseous products are passed through a gas washer to remove $H_2S$, $NH_3$, and the like. Part of the washed hydrogen-rich gas is returned to the liquid-phase hydrogenation, as recycle gas. In a subsequent distillation, naphtha, middle distillate, and vacuum gas oil are produced, in cuts as desired. In the case where coal and oil were both originally fed, the ratio of coal to oil is preferably 1:20 to 1:1, particularly 1:5 to 4:5.

Alternatively, a cold separation stage may directly follow the liquid phase hydrogenation, and in turn be followed by de-pressurization and separation of the liquid products into an aqueous phase and a mineral-oil-containing phase, then by atmospheric distillation of the oil-containing phase.

Suitable materials for the "additives" in the liquid phase hydrogenation are suspended lignite cokes from blast furnaces or hearth furnaces, granular lignite cokes, soots or the like from gasification of heavy oils, anthracite coal, lignite or hdrogenation residues and activated cokes produced therefrom, petroleum coke and dusts from Winkler gasification and high temperature Winkler gasification of coal, i.e., in general, materials with high internal surface area and a pore structure for demetallization and deasphaltization as well as for sorption of coke precursors. Alternatively one may also use "red mud" (a metallurgical residue used as a catalyst in coal liquefaction), Bayer process residue, iron oxide, or electrostatic filter dust and cyclone dust from metallurgy or ore dressing. The amount of the "additive" is preferably 0.5–5 wt. %. When carbon-containing "additives" are used, they may contain salts of metals of the Groups 3 to 12 or Group 14 of the Periodic Table. (This is a new notation according to Chemical and Engineering News, 63(5), 27, 1985. This format number the Groups 1 to 18.) Preferably salts of iron, cobalt, nickel, vanadium, or molybdenum, particularly iron (III) sulfate, are employed.

It is preferred to add, to the feed materials for the liquid-phase hydrogenation, a compound which neutralizes hydrogen halides, particularly one which neutralizes hydrogen chloride, to form salts, or a compound which yields hydroxide ions in aqueous solution. The amount of this compound added is 0.5–5 wt. %. Alternatively, this neutralizing compound or compounds may be injected, along with water, into the exit stream from the liquid phase hydrogenation reactor, e.g. into the feed pipes of the cold separator. Preferably, alkali metal compounds are used for this, in the amount of 0.5–5%, for example, sodium sulfide, sodium hydroxide, sodium carbonate, sodium acetate, potassium hydroxide, potassium carbonate or their mixtures. Also ammonium compounds such as ammonium carbonate or ammonia water mixtures are suitable, but their use is less preferred because of possible sublimation of the resulting ammonium chloride with eventual clogging of product lines. A requisite for the compound which yields hydroxide ions in aqueous solution is that chlorides are formed, which are soluble in water.

Other features of the invention will become apparent in the course of the following descriptions of exemplary embodiments which are given for illustration of the invention and are not intended to be limiting thereof.

EXAMPLES

EXAMPLE 1

A waste motor oil with 1,100 ppm (here and in the following on a weight basis) PCB was catalytically reacted with 1,500 $m^3$ hydrogen (at S.T.P.) per metric ton, in a continuous hydrogenation apparatus at 430° C. and a pressure of 280 bar. Prior to the reaction, 1 wt. % of an iron-containing ($Fe_2O_3$) dust from iron ore dressing was added to the oil and 0.2 wt. % $Na_2S$ was added. After a residence time of 1.5 hr in the hydrogenation reactor, the PCBs had been decomposed to below the analytical limit of detection, namely 1 ppm. The shift in boiling points in the oil is shown in the following Table.

TABLE

| | | Waste oil fed | Refined Material |
|---|---|---|---|
| Initial boiling point | °C.: | 256 | 98 |

TABLE-continued

| | | Waste oil fed | Refined Material |
|---|---|---|---|
| Fraction <100° C. | wt. %: | — | — |
| Fraction 100–300° C. | wt. %: | 2 | 24 |
| Fraction 300–500° C. | wt. %: | 76 | 70 |
| Fraction >500° C. | wt. %: | 22 | 5 |
| Final boiling point | °C.: | 570 | 529 |

The heavy oil fraction (300°–500° C.) in the refined material had a viscosity index of 120, which makes it a suitable base oil component for preparing a high quality motor oil.

EXAMPLE 2

To a vacuum residue from Bachaquero crude having a residuum content (b.p. >500° C.) of 6 wt. % there was added 15 wt. % of a waste industrial oil with a chlorine content 10,000 ppm. 1.8 wt. % activated coke and 0.2 wt. % $Na_2S$ were added to this mixture and it was hydrogenated in a liquid phase hydrogenation reactor at 450° C. and 220 bar. The vacuum residue was converted to the extent of 91% to light boiling components and gaseous substances, and the liquid product was free of PCBs, i.e. its PCB content was below the gas chromatographic limit of detection. The distribution of feeds and products is given below:

Feeds:

Industrial oil (b.p. <500° C.): 15 wt. %;

Vacuum gas oil (b.p. 350°–500° C. at 1 atm): 5.1 wt. %

Vacuum residuum (b.p. >500° C.): 79.9 wt. %;

Lignite coke, plus $Na_2S$: 2 wt. %;

Hydrogen: 3 wt. %.

Products:

water containing sodium chloride, $H_2S$, ammonia: 5 wt. %;

Products with 1–4 carbon atoms: 8 wt. %;

Gasoline (with 5 carbon atoms) (b.p. 200° C.): 21 wt. %;

Middle distillate (b.p. 200°–350° C.): 34 wt. %;

Higher boiling fraction (b.p. 350°–500° C.): 28 wt. %;

Residuum (including solids) (b.p. >500° C.): 9 wt. %.

The proposed method is much more economical with regard to practically complete breakdown of PCBs than is the industrially realized thermal incineration method for PCB-containing waste oils, and it avoids the problems of hazardous wastes which occur when oils containing chlorinated hydrocarbons or chlorinated biphenyls are incinerated.

Obviously, numerous modifications and variations of the present invention are possible in light of the above teachings. It is therefore to be understood that within the scope of the appended claims, the invention may be practiced otherwise than as specifically described herein.

What is claimed is:

1. A method of reacting a halogen-containing oil or a halogen-containing hydrocarbon feed material, comprising the step of:

liquid phase hydrogenating said feed material at a hydrogen pressure between about 20–325 bar, a temperature between about 250°–500° C. and a gas/oil ratio of 100–3,000 $m^3$ per metric ton at STP, wherein said hydrogenating step comprises slurry phase hydrogenation or the combination of slurry phase and catalytic hydrogenation using a fixed bed catalyst.

2. The method of claim 1, wherein said halogen-containing oil or hydrocarbon feed material, comprises an oil or hydrocarbon containing at least one compound selected from the group consisting of chlorinated aromatics, brominated aromatics, chlorinated paraffins, brominated paraffins, chlorinated cycloparaffins and brominated cycloparaffins.

3. The method of claim 1, wherein said halogen-containing oil or hydrocarbon feed material contains at least one compound selected from the group consisting of chlorinated biphenyls, brominated biphenyls, chlorinated napthalenes, chlorinated terphenyls, chlorinated paraffins, brominated paraffins, chlorinated napthenes, and brominated napthenes.

4. The method of claim 1, further comprising adding residual oil or heavy oil.

5. The method of claim 4, wherein said residual oil or heavy oil is added in an amount of about 30–100 wt. %.

6. The method of claim 5, wherein said residual oil or heavy oil is added in an amount of about 50–95 wt. %.

7. The method of claim 4, wherein said coal and said feed material are fed to said hydrogenating step in a ratio of about 1:20–1:1 by wt.

8. The method of claim 7, wherein said ratio is about 1:5–4:5 by wt.

9. The method of claim 1, further comprising adding a carbon-containing high surface area suspended solid to said liquid phase hydrogenation in an amount of 0.5–5 wt. %.

10. The method of claim 9, wherein said carbon-containing high surface area suspended solid is selected from a group consisting of lignite cokes from blast furnaces and open hearth ovens, soot from the gasification of heavy oil, anthracite coal, hydrogenation residues, lignite and activiated cokes produced from lignite, petroleum coke, dusts from Winkler gasification of coal, and mixtures thereof.

11. The method of claim 9, wherein said carbon-containing high surface area suspended solid is impregnated with a metal salt, wherein said metal is selected from Groups 3 to 12 and from Group 14 of the Periodic Table.

12. The method of claim 11, wherein said metal is selected from a group consisting of iron, cobalt, nickel, vanadium, molybdenum, and mixtures thereof.

13. The method of claim 1, further comprising adding at least one member selected from the group consisting of red mud, iron oxide, electrostatic filter dust, and cyclone dust from metallurgy or ore dressing in an amount of about 0.5–5 wt. %, to said hydrogenating step.

14. The method of claim 1, further comprising adding to said feed material 0.05–5 wt. % of a compound which neutralizes hydrogen halides to form salts or of a compound which yields hydroxide ions in aqueous solution.

15. The method of claim 14, wherein said compound is injected along with water into the exit stream from the liquid-phase hydrogenation reactor.

16. The method of claim 14, wherein said compound is an alkali metal compound and is added in an amount of about 0.01–5 wt. %.

17. The method of claim 15, wherein said compound is an alkali metal compound and is added in an amount of about 0.01–5 wt. %.

18. The method of claim 16, wherein said compound is sodium hydroxide, sodium carbonate, sodium acetate, sodium sulfide, potassium hydroxide, potassium carbonate, ammonium carbonate, ammonia-water mixtures or mixtures thereof.

19. The method of claim 17, wherein said compound is sodium hydroxide, sodium carbonate, sodium acetate, sodium sulfide, potassium hydroxide, potassium carbonate, ammonium carbonate, ammonia-water mixtures or mixtures thereof.

20. The method of claim 1, further comprising adding finely ground coal.

* * * * *